US007543723B2

(12) United States Patent
Wilford et al.

(10) Patent No.: US 7,543,723 B2
(45) Date of Patent: Jun. 9, 2009

(54) AIR VENTED LIQUID VALVE

(75) Inventors: Michael Wilford, Chicago, IL (US); Mark A. Smith, Plainfield, IL (US)

(73) Assignee: DS Smith Plastics Limited, London (GB)

( * ) Notice: Subject to any disclaimer, the term of this patent is extended or adjusted under 35 U.S.C. 154(b) by 188 days.

(21) Appl. No.: 10/591,493

(22) PCT Filed: Mar. 2, 2005

(86) PCT No.: PCT/US2005/006599

§ 371 (c)(1),
(2), (4) Date: Sep. 1, 2006

(87) PCT Pub. No.: WO2005/094425

PCT Pub. Date: Oct. 13, 2005

(65) Prior Publication Data

US 2007/0187409 A1 Aug. 16, 2007

Related U.S. Application Data

(60) Provisional application No. 60/549,184, filed on Mar. 2, 2004.

(51) Int. Cl.
*B65D 51/16* (2006.01)

(52) U.S. Cl. ..... 222/484; 222/481.5; 222/549; 137/588; 137/589; 137/625.19; 251/215; 251/229

(58) Field of Classification Search ..... 222/481, 222/481.5, 482–484, 518, 548, 549, 553, 222/555, 479, 552, 566, 571; 137/588, 589, 137/625.18, 625.19; 251/215, 218, 229, 251/309–312

See application file for complete search history.

(56) References Cited

U.S. PATENT DOCUMENTS 4,708,171 A * 11/1987 Cudaback ..... 137/588
6,533,935 B2 * 3/2003 Miller et al. ..... 210/248

* cited by examiner

*Primary Examiner*—J. Casimer Jacyna
(74) *Attorney, Agent, or Firm*—Rockey, Depke & Lyons, LLC; Kathleen A. Lyons

(57) ABSTRACT

An air-vented closure assembly for a fluid container has a valve body and a valve element. The valve body has first and second fluid conduits. The valve body has a mounting sleeve in fluid communication with the first and second fluid conduits. A valve member is positioned in the mounting sleeve for reciprocating movement from a closed position to an open position. The valve member has a wall having opposed ends, the valve member having a third fluid conduit therethrough. A first portion of the wall is removed to define an air inlet into the third fluid conduit and a second portion is removed to define an air outlet. When the valve member is in the closed position fluid flow through the first and second conduits is prevented, and when in the open position fluid can flow through the first conduit and air can flow through the air outlet.

30 Claims, 6 Drawing Sheets

FIG. 1
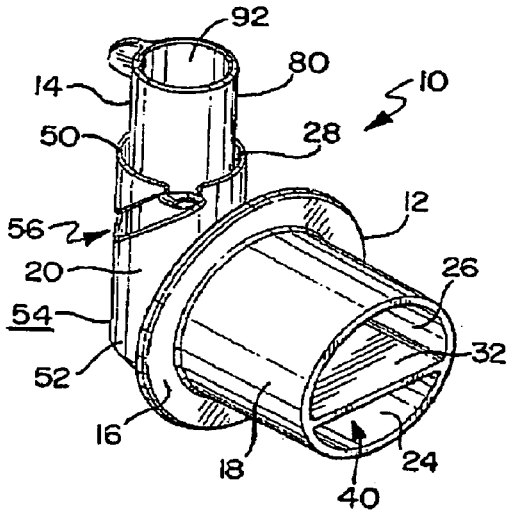
FIG. 2
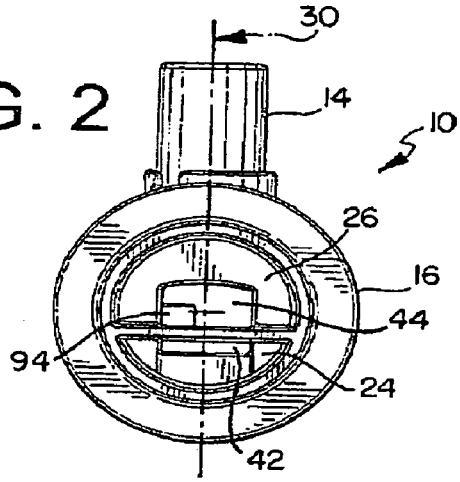
FIG. 3
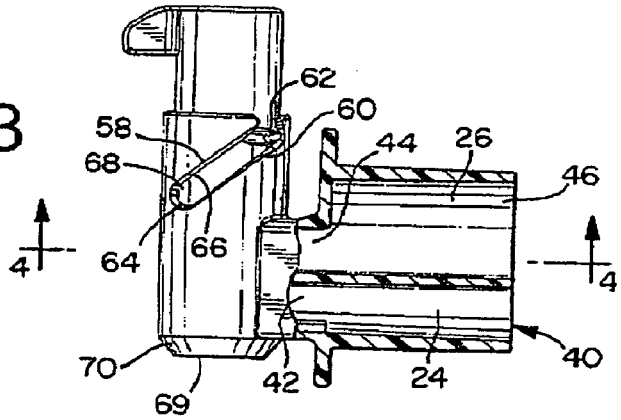
FIG. 4
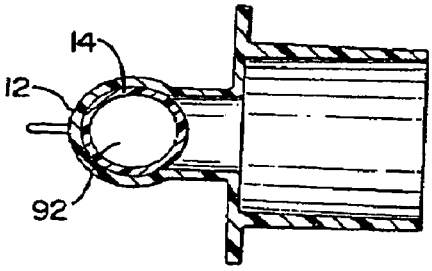
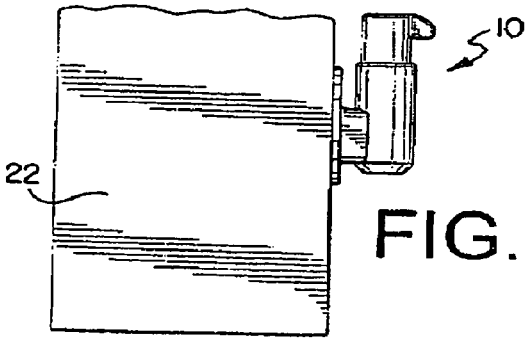
FIG. 5

FIG. 13
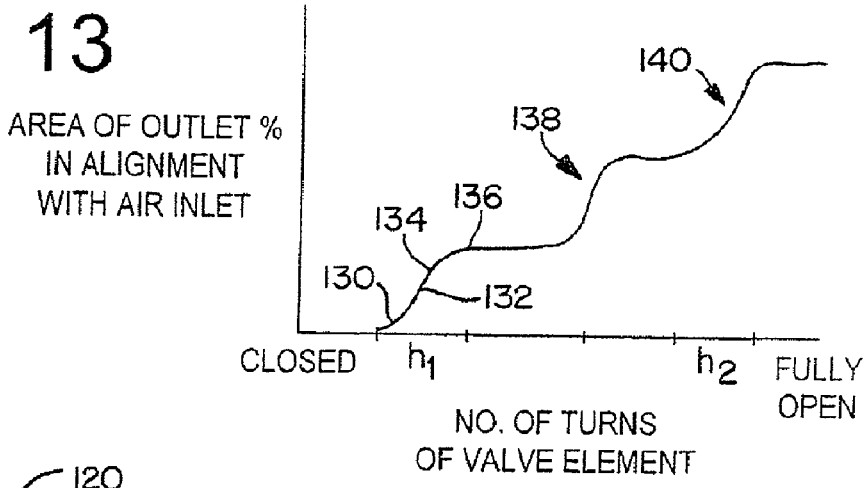
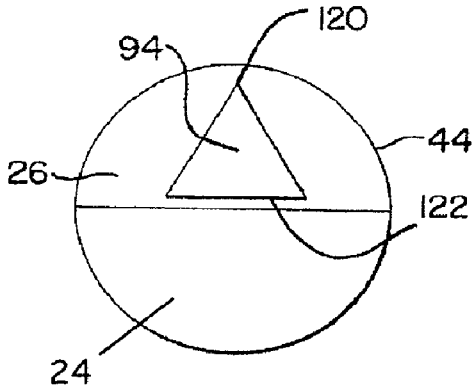
FIG. 14
FIG. 15
PRIOR ART
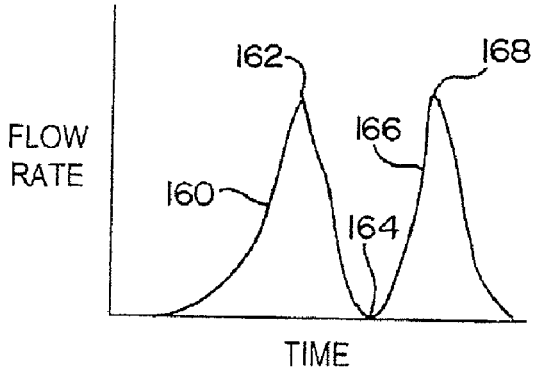
FIG. 16
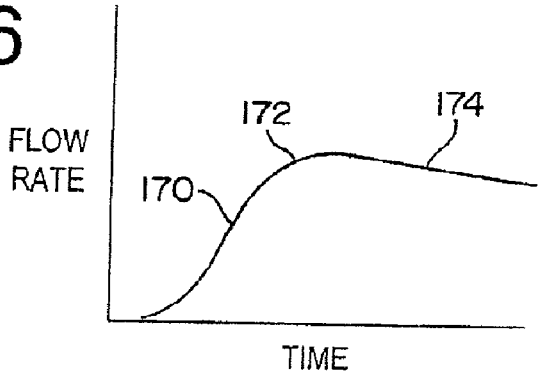

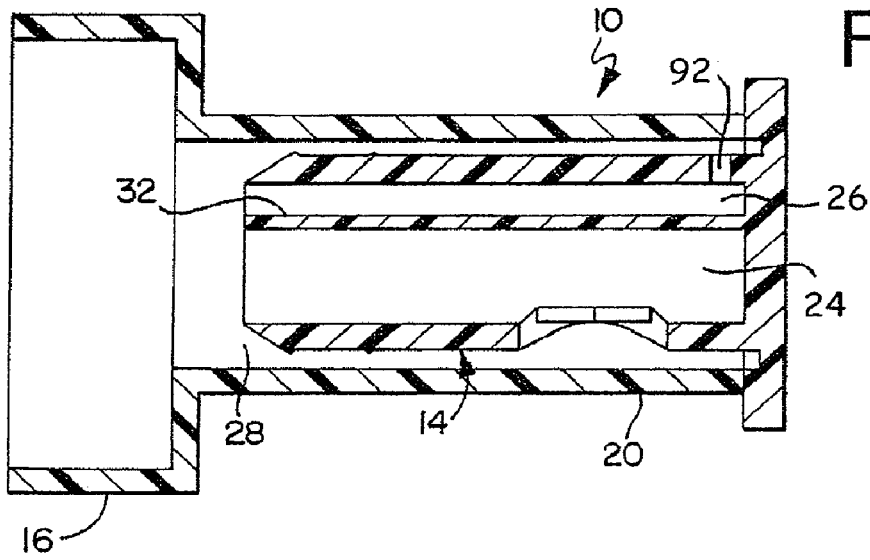
FIG. 19
FIG. 20
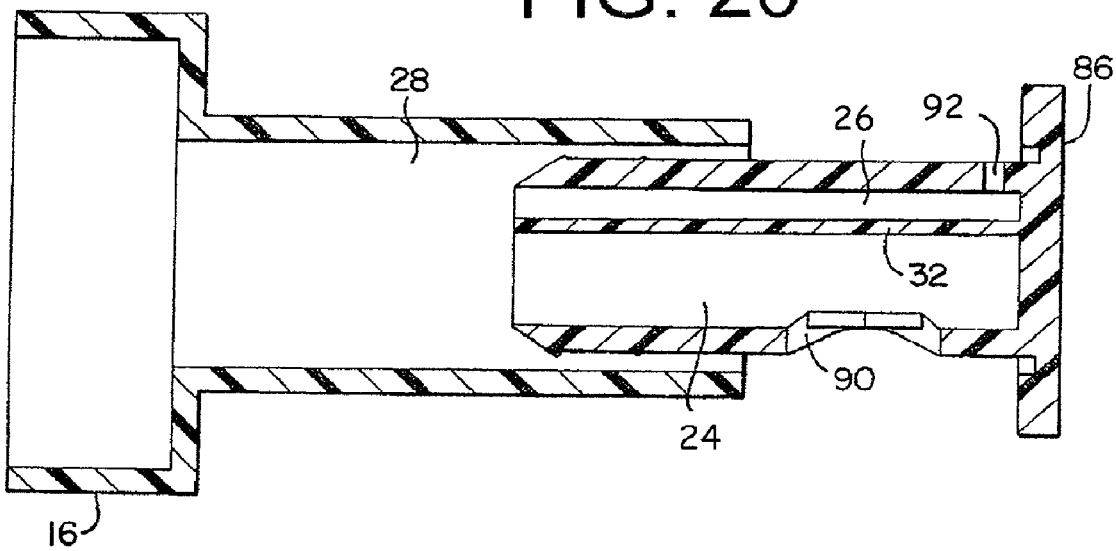
FIG. 21
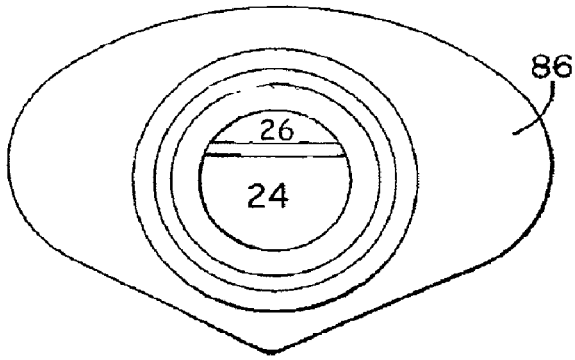

AIR VENTED LIQUID VALVE

CROSS REFERENCE TO RELATED APPLICATIONS

This application claims the benefit of U.S. Provisional Application No. 60/549,184, filed Mar. 2, 2004, whose entire contents are hereby incorporated by reference.

BACKGROUND OF THE INVENTION

It is known to provide molded plastic taps for use with containers, in particular disposable containers of the type popular for supplying liquid such as water, wine or milk. One well known type of tap for this purpose is a so-called push button tap having a resilient plastic diaphragm which, when pressed, opens the valve to allow liquid to flow from the container. The resilient plastic diaphragm, commonly referred to as a "push button," can be arranged so that it positively urges the valve into a sealing position when manual pressure is removed therefrom. The tap is therefore self-closing.

An alternative to push button taps are the so-called "rotary" taps. In these, a cap is rotated to in turn rotate a stem within the tap body. Rotation of the stem causes it to uncover an aperture provided in the tap body through which or from which liquid is dispensed.

Irrespective of the type of tap used with a container, it has been found that smooth liquid flow with a stabilized flow profile can only be achieved if either the container is flexible, collapsing as liquid is dispensed, or the container is vented. The reason for this is that otherwise air must flow into the container to fill the space from which liquid has been vacated and equalize the pressure within the container. The inflow of air disrupts the outflow of liquid causing it to be uneven and reducing the flow rate.

SUMMARY OF THE INVENTION

Disclosed herein are air-vented closures for a fluid container, each closure having a dedicated liquid conduit and a dedicated air conduit. This allows air to flow into the container without encountering static or flowing liquid in the air conduit.

In an embodiment, an air-vented closure has a body having a docking member for connecting the closure to a container. The body has a first conduit and a second conduit, the first conduit being adapted for conveying liquid and having a liquid outlet, the second conduit being adapted for conveying air and having an air inlet. The closure also has a member having opposed first and second ends with a liquid outlet at the first end and an air inlet at the second end. The member is positionable with respect to the body from a closed position where no liquid flows through the first conduit to an open position where liquid can flow through the first conduit.

In another embodiment, the closure assembly has a valve body and a valve element. The valve body has a first fluid conduit and a second fluid conduit spaced from the first conduit. The valve body has a mounting sleeve in fluid communication with the first fluid conduit and the second fluid conduit, the mounting sleeve has an axis therethrough. The valve member may be positioned in the mounting sleeve for reciprocating movement therein from a closed position to an open position in response to rotation of the valve member about the axis. The valve member has a wall having a first end and an opposed second end, the valve member having a third fluid conduit therethrough. A first portion of the wall of the valve member may be removed to define an air inlet into the third fluid conduit and a second portion may be removed to define an air outlet from the third conduit. When the valve member is in the closed position a portion of the valve member blocks fluid flow through the first conduit and a portion of the mounting sleeve blocks air flow from the air outlet. When the valve member is in the open position, fluid can flow through the first conduit and air can flow through the air outlet.

Also disclosed herein is a fluid container having an air vented closure attached thereto.

BRIEF DESCRIPTION OF THE FIGURES

FIG. 1 is an isometric view of a closure assembly of the present invention;

FIG. 2 is an end view of the closure of FIG. 1;

FIG. 3 is a side view in partial cross-section of the closure of FIG. 1;

FIG. 4 is a plan view in cross-section of the closure assembly taken along line X-X of FIG. 3;

FIG. 5 is a fluid container with the closure assembly of FIG. 1;

FIG. 13 is a plot of the area of outlet vs. number of turns of valve element of FIG. 12;

FIG. 14 is a schematic view of an embodiment of an air vent of a valve element in an open position;

FIG. 15 is a plot of flow rate vs. time showing a discontinuous flow rate;

FIG. 16 is a plot of flow rate vs. time for a continuous flow rate;

FIG. 19 is a cross-sectional view of another embodiment of an air-vented liquid valve in a closed position;

FIG. 20 is a cross-sectional view of the valve of FIG. 19 in an open position; and FIG. 21 is an end view of a valve element of the valve of FIG. 19.

DETAILED DESCRIPTION OF THE INVENTION

Figure 7:
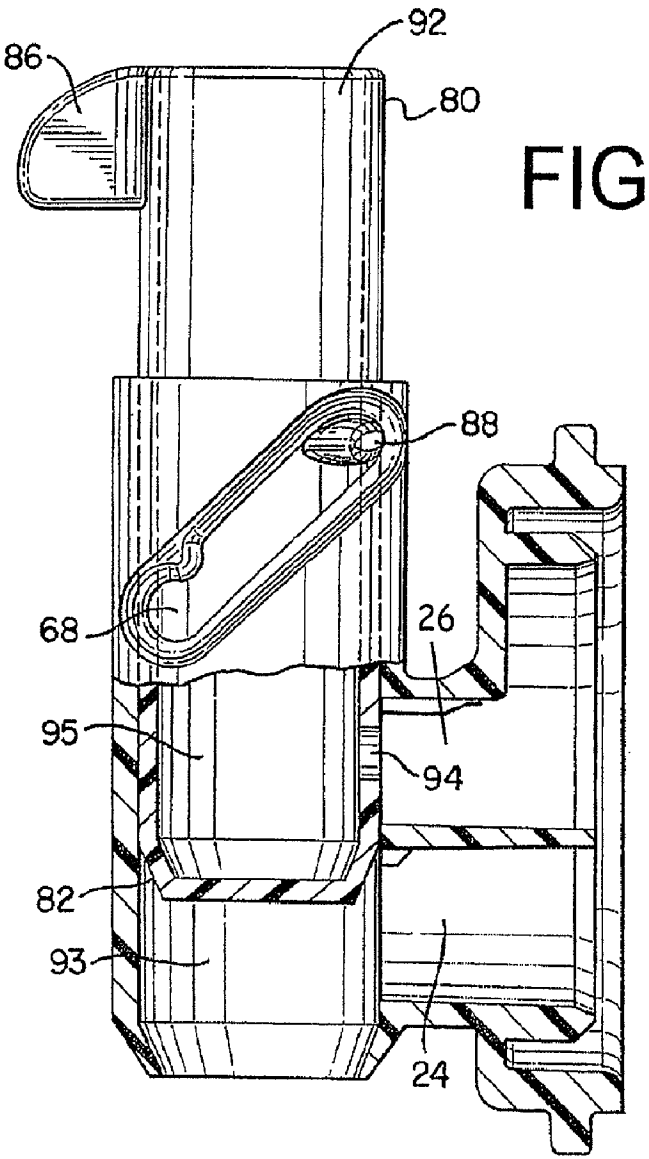
FIG. 7 is a side view in partial cross-section of the closure assembly in an open position.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

Referring now to FIGS. 1 to 4, a closure assembly 10 having a valve body 12 and a valve member 14 is shown. The valve body 12 has a docking member 16 an annular flange 18 and a mounting sleeve 20. The docking member 16 is for connecting the assembly 10 to a container 22 (FIG. 5). The annular flange 18 defines a first fluid conduit 24 and a second air conduit 26 extending parallel to one another. The mounting sleeve 20 defines a fluid channel 28 having an axis 30. The fluid channel 28 is dimensioned to coaxially receive the valve member 14. As will be described in greater detail herein, the valve member 14 is moveable from a closed position to an open position to allow liquid to flow outward from the container through the first fluid conduit 24 while air flows into the container through the second air conduit 26 without having to pass through a static or flowing liquid in the conduit.

The valve body 12 is preferably made from a polymeric material and is manufactured by a polymer processing technique. In a preferred form, the valve body is manufactured by injection molding. The first fluid conduit 24 and the second air conduit 26 are separated by a wall 32. The wall 32 divides an internal pathway of the annular flange 18 into conduits. The first liquid conduit 24 and the second air conduit 26 are shown having differing volumes yet the invention contemplates having the first conduit and second conduit having the same or approximately the same volume. In a preferred form of the invention, the volume of the first fluid conduit 24 has a ratio with respect to the second air conduit 26 of from about 0.3-4.0 and more preferably from 0.5-3.0. The first conduit 24 has a fluid inlet end 40 and a fluid outlet 42. The second conduit 26 has a first air inlet 44 and a first air outlet 46.

The mounting sleeve 20 has a generally cylindrically shaped wall having a first end 50, a second end 52 and an outer surface 54. A pair of circumferentially spaced, spiral extending grooves 56 extend from an intermediate portion of the mounting sleeve to proximate the first end 50. The grooves 56 are shown extending through the entire thickness of the sleeve 20. However, it is contemplated that grooves 56 can be provided on an interior surface of the sleeve 20 that do not extend through the entire thickness of the sidewall (less than 98% of the thickness) so that the grooves are hidden from view. The groove has a top edge 58 and a bottom edge 60 and top stop 62 and a bottom stop 64. A protuberance 66 extends from the top edge 60 proximate the bottom stop 64. A gap 68 separates the protuberance 66 from the bottom stop 64. The second end 52 of the sleeve 20 has a spout 69 having a taper 70 defining a reduced diameter portion when compared to the diameter of the remainder of the sleeve 20.

Figure 6:
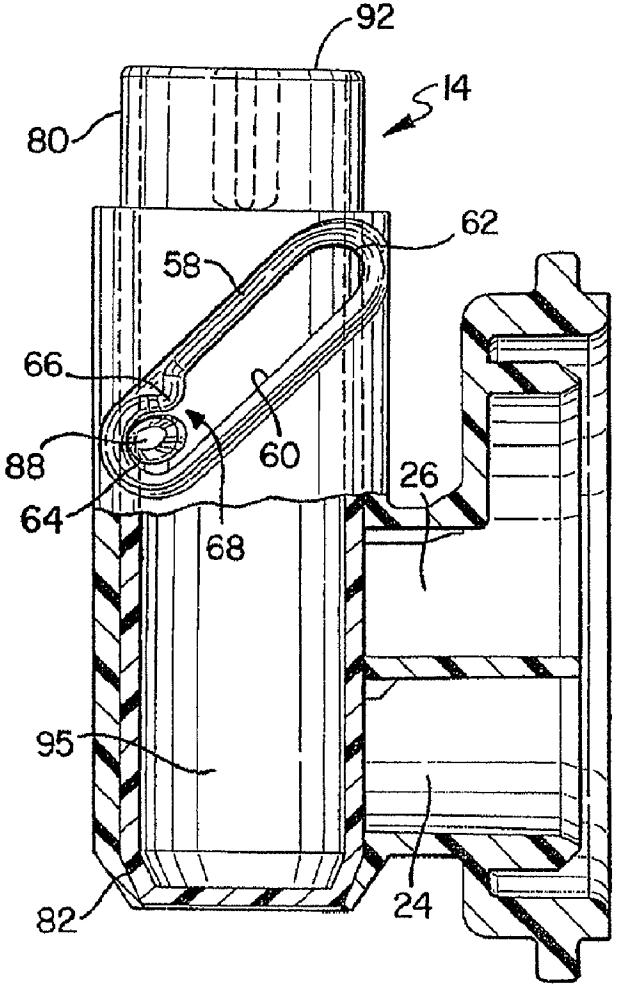
FIG. 6 is a side view in partial cross-section of the closure assembly in a closed position.

The valve element 14 has a first end 80 and a second end 82. The valve element 14 has a generally cylindrically shaped side wall having an outer surface, a gripping projection 86 at the first end 80 and a pair of circumferentially spaced pins 88. The pins 88 fit within the grooves 56 of the valve body. Rotation of the valve element 14 about the axis 30 causes reciprocating movement of the valve element 14 along the axis 30. A second air outlet 94 is formed in the side wall proximate the second end 82. When in the open position the second air outlet 94 is in alignment with the air conduit 26, but not in alignment when in the closed position. FIG. 6 shows the valve element 14 in the closed position and FIG. 7 shows valve element 14 in an open position. The protuberance 66 holds the valve element in the closed position to prevent inadvertent dispensing of liquid from the container. A force that can be generated by hand is sufficient to overcome the resistance of the protuberance to rotation of the valve element 14.

In a preferred form of the invention the ratio of volumes of the second air outlet 94 and the opening of the air conduit 26 and the configuration of the second air outlet 94 and the first air inlet 44 are selected to minimize the vacuum drawn on the container contents when activating flow of fluid through the spout. It is also desirable to provide a continuous flow during dispensing to minimize or eliminate interrupted flow from the container causing a familiar "glug" sound. In another preferred form of the invention, a water-filled 1½ gallon rigid container can be continuously dispensed (See FIGS. 17, 18) without interruption until the container is drained.

The valve element 14 has a second air inlet 92 on an end opposite the second air outlet 94, a third conduit 95 defined as running through the valve element 14 from the second air inlet 92 to the second air outlet 94. It is contemplated positioning the inlet 92 on the side wall proximate the first end 50 so that the inlet 92 is covered by the mounting sleeve when the element is in the closed position and is uncovered when moved into the open position. The inlet 92 is open to ambient air. It is contemplated closing the inlet 92 with a valve, such as a flapper valve, which would open when the valve element is in the open position.

FIG. 5 shows the assembly 10 mounted to a container 22. The container can be made from polymeric materials, paperboard, or metal. In a preferred form, the container is a polymeric material shaped into a container by any suitable polymer processing techniques such as injection molding, blow molding, by sealing sheets of material together to define a container or other suitable process. Suitable polymers include, but are not limited to, homopolymers and copolymers of polyolefins, polyamides, polyesters or other suitable material. One particularly suitable material is a homopolymer of ethylene and more preferably one having a density of greater than about 0.915 g/cc. In another embodiment, the material is an HDPE. In a preferred container, the sidewalls will have a modulus of elasticity of greater than 20,000 psi. In another preferred form of the container, the sidewalls of the container will not substantially collapse upon draining the contents of the container.

The configuration of the second air outlet 94 and the first air inlet 44 can take on many forms as shown in representative embodiments shown in FIGS. 8-12 and 14. The shape and size of the first air inlet 44 and/or second air outlet 94 can take on numerous forms including circular, semi-circular, oval, polygonal, irregular or amorphous. The first air inlet 44 can also be divided into separate chambers by a dividing wall extending between or within the internal surfaces of the first air inlet 44. It is also contemplated the first air inlet 44 may terminate with a wall having a singular outlet having one of the many shapes set forth above or have a series of sub-outlets of any shape or combination of shapes.

Figure 8:
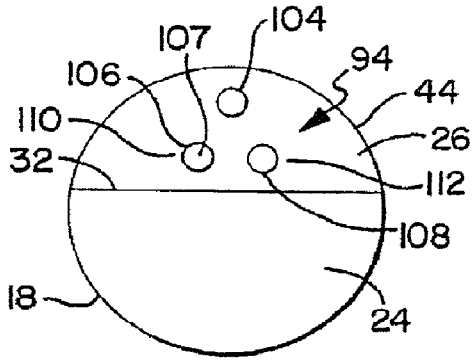
FIG. 8 is a schematic view of an embodiment of an air vent of a valve element in an open position.

For the sake of brevity, FIGS. 8-12, and 14 are shown with the first air inlet 44 that is semicircular in shape with the valve element 14 in the full open position. It should be understood the semi-circular shape of the first air inlet 44 can be replaced by any one of the shapes or configurations described above. FIG. 8 shows the second air outlet 94 having three circular shaped sub-outlets each of approximately equal area form a triangular shape, and particularly an equilateral triangle. Thus, the sub-outlets can be positioned to form a pattern that is circular, semi-circular, oval, polygonal, irregular or amorphous. When moving the valve element from a closed position to an open position, the first sub-outlet 104 comes into alignment with the first air inlet 44 followed by the second sub-outlet 106 and then the third sub-outlet 108. The first sub-outlet comes into alignment with the first air inlet 44 at it is positioned higher on the valve element than the other sub-outlets. The second sub-outlet is on a leading edge 110 of the valve element, and, therefore a leading edge portion 107 of the sub-outlet 106 initially comes into alignment with the first air inlet 44 and then is joined by the third sub-outlet positioned on a trailing edge 112 of the valve element.

Figure 9:
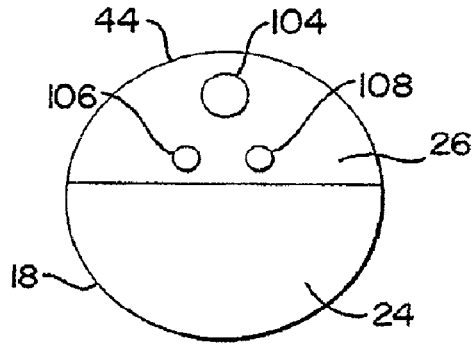
FIG. 9 is a schematic view of an embodiment of an air vent of a valve element in an open position.

FIG. 9 shows a similar configuration of sub-outlets as FIG. 8 with the exception that the first sub-outlet 104 has a greater area than the second and third sub-outlets 106,108.

Figure 10:
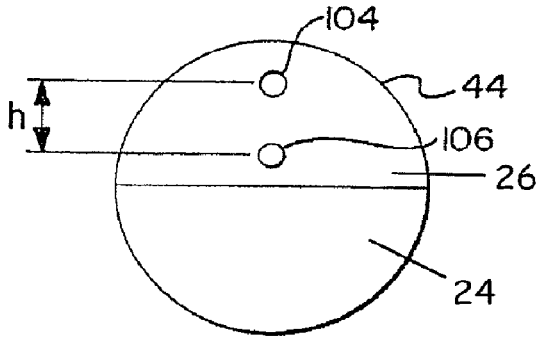
FIG. 10 is a schematic view of an embodiment of an air vent of a valve element in an open position.
Figure 11:
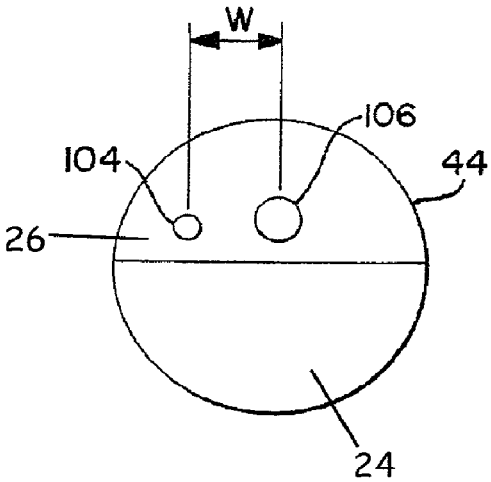
FIG. 11 is a schematic view of an embodiment of an air vent of a valve element in an open position.

FIGS. 10 and 11 show a valve element having two-sub-outlets 104 and 106. FIG. 10 shows the first sub-outlet 104 positioned above the second sub-outlet. The distance between the first sub-inlet and the second sub-inlet can be traversed upon rotation of the valve element by a number of turns about the axis of from about $1/8^{th}$ of a turn to 1 full turn. FIG. 11 shows the first sub-outlet 104 positioned a distance ahead of the second sub-outlet 106 and this distance should be traversed by a number of turns about the axis of from about $1/8^{th}$ of a turn to 1 full turn.

Figure 12:
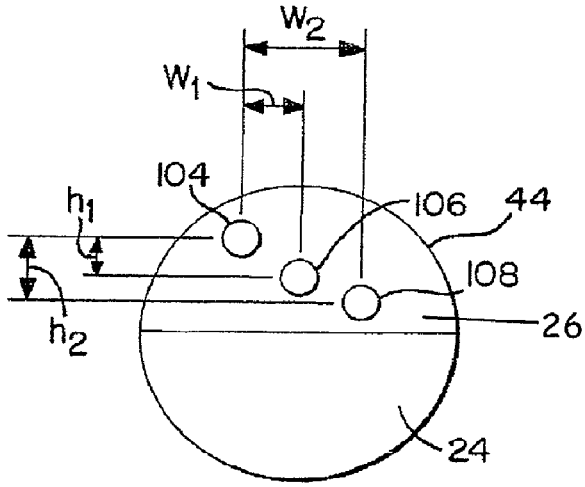
FIG. 12 is a schematic view of an embodiment of an air vent of a valve element in an open position.

FIG. 12 shows a valve element having three sub-outlets having the second sub-outlet 106 spaced a distance h1 and w1 from the first outlet and the third sub-outlet 108 spaced a distance h2 and w2 from the first sub-outlet 104. Thus the three sub-outlets form a line having a slope h2/w2.

FIG. 13 shows a graph of the area of alignment between the air outlet 94 versus the number of turns of the valve element 14 for the embodiment shown in FIG. 12. Initially the valve element is rotated for a lead in section where there is no alignment between the outlet 94 and the first inlet 44. As the first sub-outlet 104 comes into alignment with the inlet 44 there is an initial increase in the alignment volume at an increasing rate up to the point where half the first circular sub-outlet 104 has been reached 132, to form a first inflection point, and continues to increase at a declining rate 134 until the first sub-outlet 104 is in alignment with the inlet 44. The inflection point 134 is reached when the valve element has traveled a distance corresponding to h1 in FIG. 12. The area does not change 136 and the curve flattens until the second circular sub-outlet begins to come into alignment with the air inlet 44 and increases similarly at 138 as with the first sub-outlet. The third sub-outlet then comes into alignment and also increases the area in a similar fashion 140 as the first and second sub-outlets. By having the sub-outlets positioned on the valve element in these orientations allows for a sequential and discontinuous (interrupted by periods where rotation of the valve element does not increase the area of alignment) increase in the volume of the area of the sub-outlets that are in alignment with the air inlet 44.

FIG. 14 shows a valve element with a single air outlet 94 having a triangular shape. The relatively narrow top 120 versus the wider bottom 122 allows for a continuous increase in area of alignment at an ever increasing rate 170 until the triangle is in full alignment and a maximum area is reached 172 and no increases 174 thereafter (FIG. 16).

FIG. 15 is a plot of flow rate over time for a rigid container where the flow rate increases 160 up to a rate 162 and then quickly returns to zero 164 or substantially slows 20 followed by a rapid increase 166 to a second maximum 168 and so on. This is the interrupted flow rate that occurs when a container is not properly vented and is accompanied by a "glug" sound.

FIG. 16 shows a desired flow rate over time where the flow steadily increases 170 and levels off at a maximum flow rate 172 that remains relatively constant 174.

To use the container 22 and closure assembly 10 of FIG. 5, one starts with the container 22 having a fluid content with the valve element 14 in the closed position (FIG. 6) so that no fluid can flow from the container. The second end of the valve element 82 blocks the fluid outlet 24. Upon rotation of the valve element 14 about the axis 30, the pins 88 rotate within the grooves 56 past the protuberance until the pins reach the stop 62. In this position, the second air outlet 94 is in alignment with the first air inlet 44. Also, in the open position, a gap 93 (FIG. 7) exists between the second end 82 of the valve element and the fluid outlet 42. Fluid from the container is free to flow through the fluid inlet 40, through conduit 24, through the fluid outlet 42, through the gap 93, through the second end of the valve body and finally through the spout 69.

Figure 17:
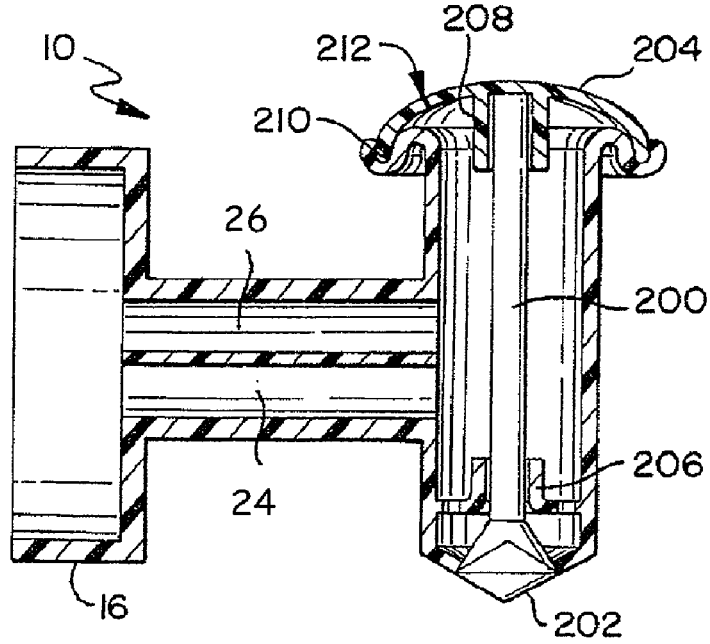
FIG. 17 is a cross-sectional view of another embodiment of an air-vented liquid valve in a closed position.

FIG. 17 shows another embodiment of the closure 10. The majority of parts are the same and therefore like reference numerals will be used for like parts. The primary difference is the valve element 14 has a valve stem 200, a septum 202 and a push button 204. The valve stem 200 extends through an annular guide 206 and is connected to the push button by an elongate boss 208 depending from a bottom surface of the push button. The annular guide 206 has a plurality of openings therein to allow fluid to flow through the guide. The boss 208 forms an interference fit with the valve stem. It is contemplated adding a second or more than two annular guides 206.

The push button is formed from an elastomeric material such as ethylene vinyl acetate (EVA); ethylene a-olefin copolymers such as VLDPE, LLDPE, ULDPE, and preferably those obtained using a single-site catalyst and even more preferably a metallocene catalyst; ethylene homopolymers; synthetic rubbers; latex; ethylene propylene rubber; ethylene propylene diene monomer (EPDM) and styrene and hydrocarbon copolymers and more preferably styrene and hydrocarbon block copolymers including di-block, tri-block, star block and more preferably SEB, SEBS, SEP, SEPS, SIS and the like. The push-button material may also be fabricated from blends of these materials. In a preferred form of the invention the push button material is EVA.

Figure 18:
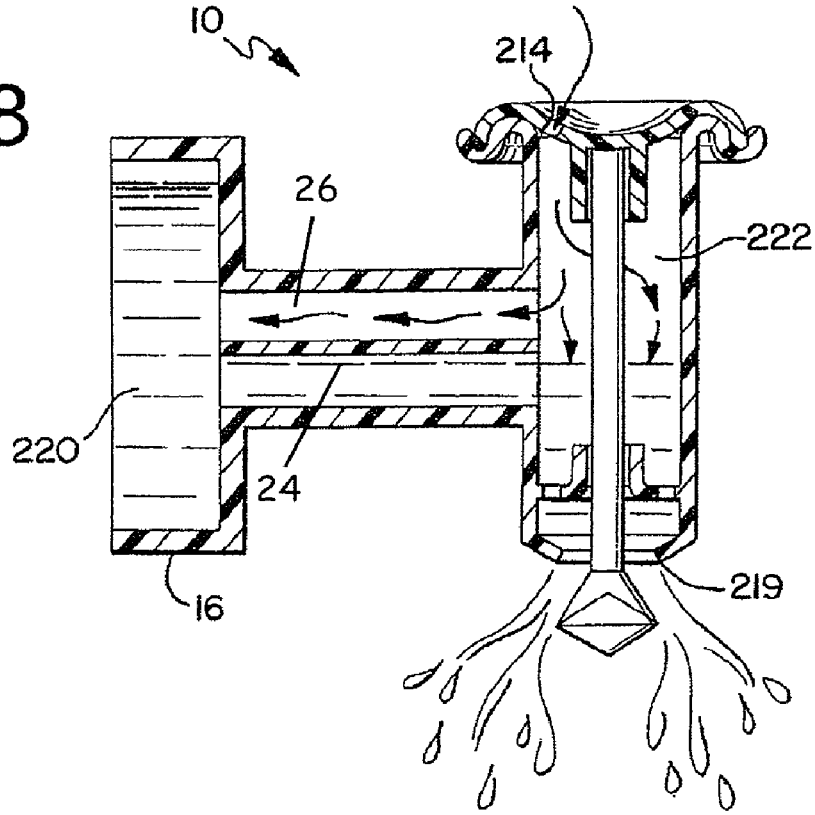
FIG. 18 is a cross-sectional view of the valve of FIG. 17 in the open position.

The push button is attached to the first end 50 of the cylindrical body in an annular rim 210 where it forms an interference fit within the rim. In another preferred form of the invention a portion of the cylindrical side wall will be swaged over a circumferential portion of the septum to lock it in place. The push button has a slit 212 which is pressed into a closed position until the button is pressed and the slit opens to form an air inlet 214 (FIG. 18). While only a single slit 212 is shown it is contemplated using more than one slit and positioning the slit or slits in a position where a user can press the push button without covering the slit.

As shown in FIG. 17, the septum 202 is frustoconically shaped. When the valve element is in a closed position, the septum sealing engages a complementary shaped valve seat 219 at the second end 52 of the mounting sleeve. The septum is preferably fabricated from one of the polymeric materials described above and preferably has some elastomeric properties to flex so that it can be brought into tight engagement with the valve seat to form a fluid tight seal.

FIG. 18 shows that pathway of the liquid evacuating from the closure 220 and the pathway of air 222 into the container.

FIGS. 19 and 20 are other embodiments of the present invention and like parts will be referred to like numerals. This closure is a slide type closure wherein the valve element 14 is mounted in the mounting sleeve 20. In this embodiment there is no annular flange as in the embodiments shown in FIGS. 1 and 18. Instead, the valve element 14 defines the air conduit 26 and the liquid conduit 24 which are divided by the wall 32. A portion of the valve member is removed to define the air inlet 92 and on an opposite side of the valve member another portion is removed to form the liquid outlet 90. A gripping flange 86 as is best seen in FIG. 21 is dimensioned for a user to grasp and slide away from the mounting sleeve to uncover both the air inlet 92 and the liquid outlet 90 to place the valve element in an open position.

While specific embodiments have been illustrated and described, numerous modifications come to mind without departing from the spirit of the invention and the scope of protection is only limited by the scope of the accompanying claims.

The invention claimed is:

1. An air-vented closure assembly for a fluid container comprising:

a valve body having a docking member for connecting the closure to the container, the valve body having a first conduit and a second conduit extending longitudinally therein, the first conduit is adapted for conveying liquid and has a first liquid inlet and a first liquid outlet, the second conduit is adapted for conveying air and has a first air inlet and a first air outlet;

a generally cylindrical mounting sleeve connected to the valve body having a fluid channel and a longitudinal axis therethrough extending transverse to the first and second conduits, the mounting sleeve having a first opening and a second opening at opposed ends and a third opening intermediate the first opening and the second opening; and a valve element having a generally cylindrical wall positioned coaxially within the fluid channel and having opposed first and second ends with a second liquid outlet at the first end and a second air inlet at the second end and a third opening intermediate the first and second ends, the valve element being mounted for rotational movement about the axis and reciprocating movement along the axis from a closed position where no liquid flows through the first conduit to an open position where the third opening is in fluid communication with the second conduit where liquid can flow through the first conduit and air can flow through the second conduit.

2. The closure of claim 1 wherein the first conduit extends in a first direction parallel to the second conduit.

3. The closure of claim 2 wherein the valve element is mounted for reciprocating movement in a second direction.

4. The closure of claim 3 wherein the second direction is transverse to the first direction.

5. The closure of claim 4 wherein the valve element has an axis and is moveable in the second direction upon rotation of the valve element about the axis.

6. The closure of claim 5 wherein the valve element has a generally cylindrically shaped side wall dimensioned so as to abut an inner surface of the mounting sleeve.

7. The closure of claim 6 wherein the cylindrically shaped wall has a top wall having a portion removed to define the second air inlet.

8. The closure of claim 7 wherein the second air inlet is centrally disposed on the top wall.

9. The closure of claim 7 wherein the cylindrically shaped wall has a solid continuous top wall and has a portion removed from the cylindrical wall proximate the top wall to define the second air inlet.

10. The closure of claim 7 wherein the second end of the cylindrical wall has a reduced diameter portion compared to the first end of the cylindrical wall.

11. The closure of claim 1 wherein the mounting sleeve has a spirally extending groove and the cylindrically shaped wall has a peg fitting into the groove so that rotation of the wall causes movement of the wall along the axis.

12. The closure of claim 11 wherein the cylindrically shaped wall blocks the flow of liquid from the first liquid outlet when the member is in the closed position by sealing off the first liquid outlet.

13. The closure of claim 12 wherein in the open position the second air outlet is in alignment with the first air inlet and the wall does not block the first liquid outlet.

14. The assembly of claim 11 wherein the mounting sleeve wall has a thickness and an interior surface and wherein the groove extends through a portion of the thickness.

15. The assembly of claim 14 wherein the groove extends through less than 98% of the thickness of the sleeve wall.

16. The assembly of claim 15 wherein the groove extends through the entire thickness of the sleeve wall.

17. The assembly of claim 16 wherein the valve body has a first peg extending from the wall and is mounted in the first groove.

18. The assembly of claim 16 further comprising a second spirally extending groove on the sleeve circumferentially spaced from the first groove and a second peg on the wall is mounted in the second groove.

19. The assembly of claim 17 wherein when the valve body is in the closed position the first peg is positioned at a first end of the first groove and when the valve body is in the open position the first peg is in the second end of the first groove.

20. The assembly of claim 19 wherein the first groove has a protuberance proximate the first end which engages the first peg when the valve body is in the closed position.

21. The assembly of claim 14 wherein the mounting sleeve has a liquid output spout formed at one end, the spout has an inner surface having a first taper portion defining a first reduced inner diameter portion.

22. The assembly of claim 21 wherein the valve member has an outer surface having a second taper portion defining a second reduced outer diameter portion at one end thereof, the second taper portion being concentrically positioned within the first taper portion when the valve body is in the closed position.

23. The assembly of claim 15 wherein the third opening has a shape selected from the group consisting of circular, semi-circular, oval, polygonal, irregular or amorphous.

24. The assembly of claim 23 wherein the third opening comprises a plurality of sub-outlets.

25. The assembly of claim 24 wherein each of the sub-outlets have a shape selected from the group consisting of circular, semi-circular, oval, polygonal, irregular or amorphous.

26. The assembly of claim 24 wherein the sub-outlet is circular.

27. The assembly of claim 25 wherein the sub-outlets form a pattern.

28. The assembly of claim 27 wherein the pattern is selected from the group consisting of circular, semi-circular, oval, polygonal, irregular or amorphous.

29. The assembly of claim 27 wherein the pattern is a triangle.

30. The assembly of claim 29 wherein the triangle is an equilateral triangle.

* * * * *